United States Patent [19]

Sheu

[11] Patent Number: 4,688,659

[45] Date of Patent: Aug. 25, 1987

[54] EMERGENCY DESCENT DEVICE

[76] Inventor: Por-Jiy Sheu, No. 111, Chien-Chen Lane, Chien-Chen District, Kaohsiung, Taiwan

[21] Appl. No.: 947,877

[22] Filed: Dec. 30, 1986

[51] Int. Cl.[4] ..... A62B 1/12; A62B 1/16

[52] U.S. Cl. ..... 182/238; 182/233; 188/268

[58] Field of Search ..... 182/71, 75, 233, 238, 182/241; 188/268, 290; 254/377

[56] References Cited

U.S. PATENT DOCUMENTS 3,847,377 11/1974 Byrd ..... 254/377

3,946,989 3/1976 Tsuda ..... 182/241

4,018,423 4/1977 Belew ..... 182/238

4,454,997 11/1985 Sheu ..... 182/233

*Primary Examiner*—Reinaldo P. Machado

*Attorney, Agent, or Firm*—Shlesinger, Arkwright, Garvey & Fado

[57] ABSTRACT

An emergency descent device includes a fluid-filled chamber with telescopic vanes of variable vane surface for self-adjusting the retarding force of the fluid, and an annular friction member in the chamber for simultaneous rotation with the vane members when the centrifugal force of the vane members is increased and the vane members extend radially outward to reach and engage with the annular friction member.

4 Claims, 4 Drawing Figures

EMERGENCY DESCENT DEVICE

This invention is an improvement of application of U.S. patent application Ser. No. 709,211 which was filed on Mar. 7, 1985, and is granted to U.S. Pat. No. 4,554,997.

BACKGROUND OF THE INVENTION

This invention relates to an emergency descent device, particularly to one having a fluid rotation-retarding device for controlling the rate of descent.

Emergency descent devices having a rotating spool with a cable wound thereon and a fluid rotation-retarding means are known in the prior art. U.S. Pat. Nos. 4,018,423, 3,847,377 and 3,946,989 disclose descent devices having fluid rotation-retarding units which include one or more vane members dividing a fluid-filled, sealed housing into two or more variable volume chambers which are then communicated by providing one or more passages. These passages are adjustable to control the rotation rate of the vane. However, the adjustment of the passage is usually done manually. In the parent application of the present application, a self-adjusting fluid rotation-retarding unit is suggested, having telescopic vane members extensible by the centrifugal force induced by the descending of the load. The telescopic vane members when extended provide an increased surface area to interact with the fluid, thereby increasing the retarding effect of the retarding unit. The retarding capacity of the retarding unit is self-adjusted by means of the centrifugal force.

SUMMARY OF THE INVENTION

An object of the present invention is to provide an emergency descent device of the above described self-adjusting type with improvements which increase the retarding capacity as well as the ability of the device to bear a larger load.

Another object of the present invention is to provide an emergency descent device of reduced size and weight.

The invention provides an emergency descent device which comprises: a rotating spool holding a cable used to connect to a person or a load, and a rotation-retarding means for controlling the rotation of the spool. The retarding means includes a fluid-filled housing of circular cross-section, an annular friction means mounted annularly and movably in the fluid housing near the inner periphery of the housing and having two inwardly extending axial projections at two diametrically opposing positions of the annular friction means, and a plurality of telescopic vane members mounted in the chamber and coaxial with the spool. The telescopic vane members are normally retracted radially inward and extensible radially outward by a centrifugal force to reach and engage with the axial projections.

Preferably, each of the telescopic vane members has an outermost engaging end which diverges radially outward, and each of the axial projections has a transverse cross-section which diverges radially inward.

According to one aspect of the invention, an emergency descent device comprises: a spool with a cable wound thereon; a pulley housing; a pulley over which said cable is passed mounted in the pulley housing; a rotation retarding means having a fluid-filled housing connected to the pulley housing, an annular friction means mounted annularly and movably in the fluid-filled housing near the inner periphery of the housing and having two inwardly extending axial projections at diametrically opposite positions of the annular friction means, and a plurality of telescopic vane members mounted in the fluid housing and coaxial with the pulley. The telescopic vane members are normally retracted radially inward and extensible radially outward by a centrifugal force to reach and engage with the axial projections for simultaneous rotation. A mounting means is connected to the pulley housing and the fluid-filled housing. Guide rollers may be further mounted in the pulley housing for guiding the cable.

The present exemplary preferred embodiment will be described in detail with reference to the accompanying drawings, in which:

DETAILED DESCRIPTION OF THE PREFERRED EMBODIMENT

Figure 1:
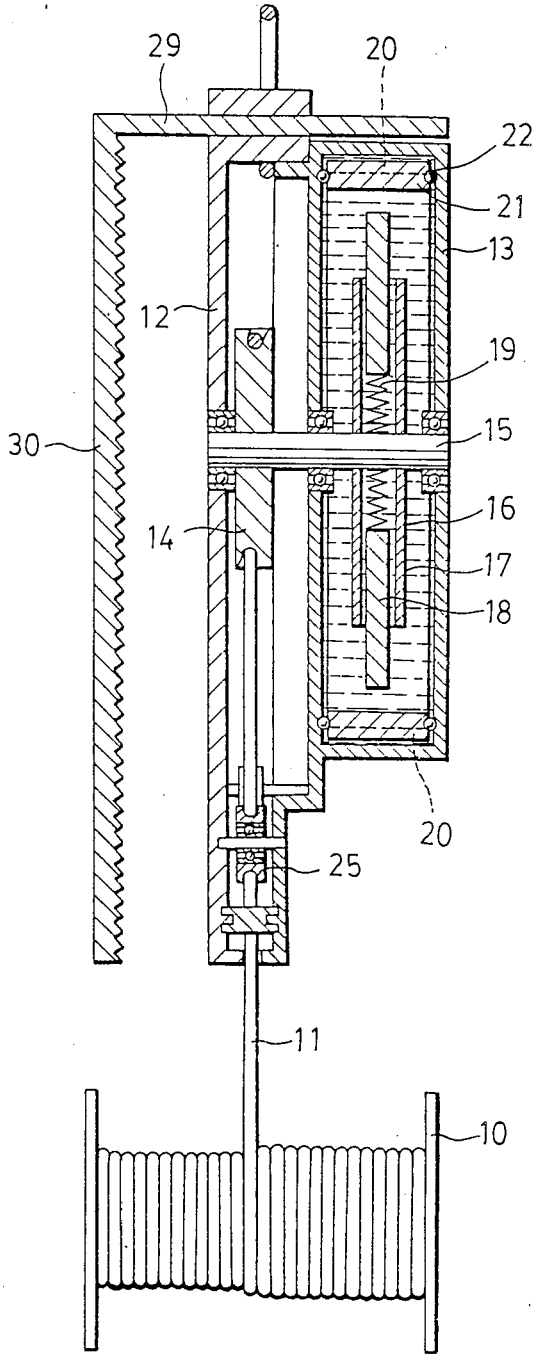
FIG. 1 is a sectional view of an emergency descent device according to the present invention.
Figure 2:
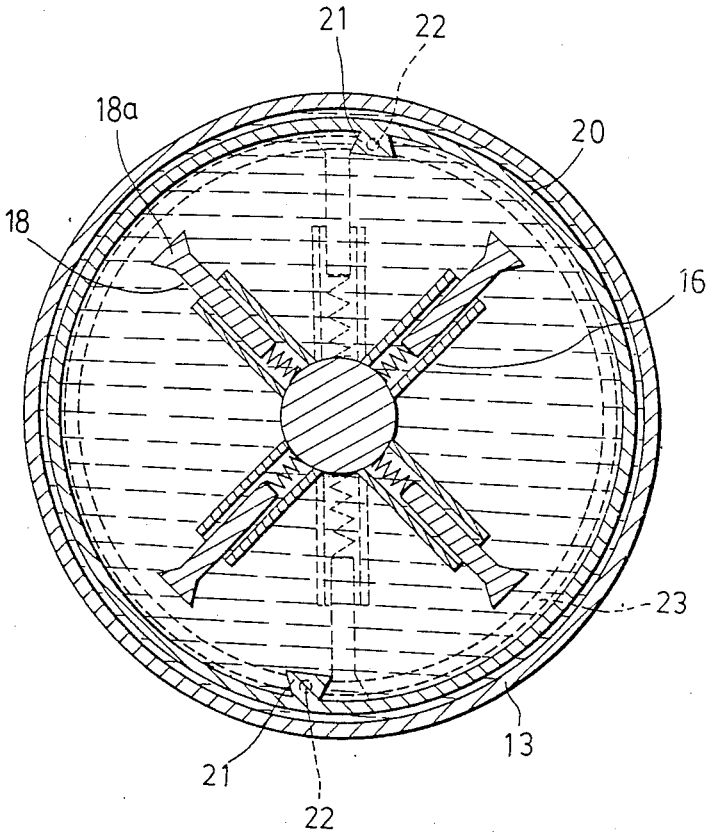
FIG. 2 is a sectional view taken along line 2—2 of FIG. 1.
Figure 3:
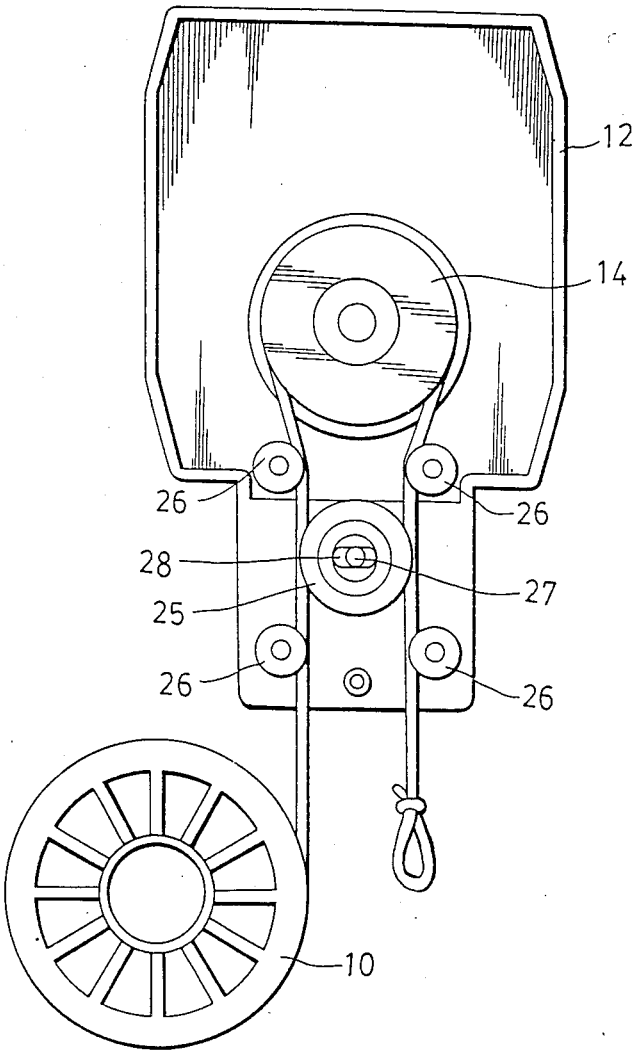
FIG. 3 is an elevation view of a pulley housing from which the fluid-filled housing is removed.
Figure 4:
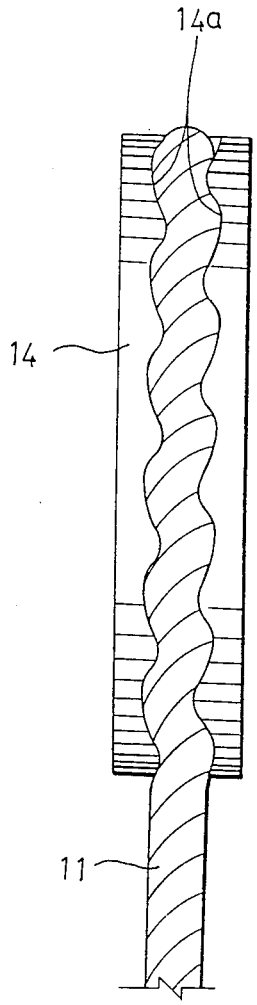
FIG. 4 is a fragmentary elevation view of a pulley with a groove defined by corrugated side walls for receiving a cable.

Referring to the drawings, an emergency descent device according to the invention is shown having a reel 10 with a cable 11 wound up thereon, and a pulley housing 12 and a fluid-filled housing 13 connected one another. A common shaft 15 is journalled in the walls of the housings 12 and 13. In the pulley housing 12 is a pulley member 14 mounted on the shaft 15. The cable 11 is drawn into the pulley housing 12 and passed over the pulley 14, and the free end of the cable 11 is drawn out from the pulley housing 12. Preferably, the pulley 14 is arranged such that it has an annular groove defined by two opposing corrugated side walls **14*a* for receiving the cable 11, as shown in FIG. 4, this so that pulley 14** provides a measure of friction force to slow the sliding movement of the cable.

A plurality of telescopic vane members 16 are mounted on the shaft 15 in the fluid-filled housing 13. Each vane member 16 has a vane shell 17 extending radially from the periphery of the shaft 15 and a vane core 18 disposed in the vane shell 17 and connected to the periphery of the shaft 15 by means of an extension spring 19. The vane cores 18 are normally retracted in the vane shells 17. Each vane core 18 is provided with an outermost engaging end **18*a* which diverges radially outward, preferably in a truncated triangular shape. The vane cores 18 will be extended radially outward from the vane shell 17** by centrifugal force.

There is an annular friction member 20 disposed annularly in the fluidfilled housing 13 near the inner periphery of the housing 13. The annular friction member 20 has two inwardly extending axial projections 21 which preferably has a transverse cross-section of truncated triangular shape, diverging radially inward. Each axial projection is provided, at the two opposite ends thereof, with two ball-shaped protrusions 22 respectively which are received slideably in two opposite annular grooves 23 disposed in two opposite walls of the fluid housing 13. When the vane cores 18 extend radially outward to the axial projections 22 of the annular friction member 20, the outermost engaging ends 18*a* of two vane cores 18 engage with the axial projections 21, and the annular friction member 20 rotates simultaneously with the vane members 16.

There are further provided a larger guide roller 25 and four smaller guide rollers 26 for guiding the cable 11 which is directed to the pulley 14 from the spool 10 and then hung from the pulley 14. The guide rollers 25 and 26 are mounted in the lower portion of the pulley housing 12. The larger guide roller 25 is limitedly movable since it is mounted on a shaft 27 which is journalled in elongated holes 28 provided in the pulley housing 12. A mounting arm 29 is fixed to the pulley casing 12 and has a downwardly extending toothed catching portion 30 which can clamp and engage firmly with a wall of any structure for mounting the present device for use.

In operation, the spool 10 is first lowered to the ground, and then the free end of the cable 11 is tied around the person or load to be lowered. When the load descends by gravity, the shaft 15 rotates simultaneously with the pulley 14, causing the vane members 16 to rotate. Due to the centrifugal force of the vane members 16, the vane cores 18 extend radially outward, thereby increasing the vane surfaces as well as the retarding force of the fluid applied thereon. The centrifugal force depends on the weight of the load. Under a certain load, the vane cores 18 extend to engage with the axial projections 21 of the annular friction member 20, moving the annular friction member 20 therealong. In this situation, the viscous fluid of the fluid chamber 12 not only acts on the vane members 16 but also applies a friction force on the friction member 20, increasing the retarding force of the fluid.

It can be appreciated that the descent device of the invention can be used for a load greater the the device previously disclosed in the parent U.S. application and thus eliminates the use of a speed reduction gear assembly as is empolyed in the previous device. Accordingly, the device according to the present invention has a reduced size and can be carried conveniently.

With the invention thus explained, it is apparent that various modifications and variations can be made without departing from the scope of the present invention. It is therefore intended that the invention be limited as indicated in the appended claims.

What I claim is:

1. An emergency descent device comprising a rotating spool holding a cable used to hang a person or a load, and a rotation-retarding means for controlling the rotation of the spool, said retarding means including a fluid-filled housing of circular crosssection, an annular friction means mounted annularly and movably in said fluid housing near the inner periphery of said housing and having two inwardly extending axial projections at two diametrically opposing positions of said annular friction means, and a plurality of telescopic vane members mounted in said chamber and coaxial with said spool, said telescopic vane members being normally retracted radially inward and extensible radially outward by a centrifugal force to reach and engage with said axial projections.

2. An emergency descent device as claimed in claim 1, wherein each of said telescopic vane members has an outermost engaging end which diverges radially outward, and each of said axial projections has a transverse cross-section which diverges radially inward.

3. An emergency descent device comprising:

a spool with a cable wound thereon;

a pulley housing;

a pulley over which said cable is passed mounted in said pulley housing;

a rotation retarding means having a fluid-filled housing connected to said pulley housing, an annular friction means mounted annularly and movably in said fluid-filled housing near the inner periphery of said housing and having two inwardly etending axial projection at diametrically opposite positions of said annular friction means, and a plurality of telescopic vane members mounted in said fluid housing and coaxial with said pulley, said telescopic vane members being normally retracted radially inward and extensible radially outward by a centrifugal force to reach and engage with said axial projections for simultaneous rotation; and a mounting means connected to said pulley housing and fluid-filled housing.

4. An emergency descent device as claimed in claim 3, further comprising guide rollers mounted in said pulley housing for guiding said cable.

* * * * *